US006939181B2

(12) United States Patent
Murphy et al.

(10) Patent No.: US 6,939,181 B2
(45) Date of Patent: Sep. 6, 2005

(54) ASSEMBLY AND METHOD FOR CONNECTING ELECTRICAL MEDICAL COMPONENTS

(75) Inventors: John X. Murphy, Haltom City, TX (US); Manfred Luedi, Fort Worth, TX (US); Alan Bredon, Colleyville, TX (US); Mitchell Sherry, Fort Worth, TX (US); Eddie Abshire, Forth Worth, TX (US)

(73) Assignee: Medtronic, Inc., Minneapolis, MN (US)

( * ) Notice: Subject to any disclaimer, the term of this patent is extended or adjusted under 35 U.S.C. 154(b) by 0 days.

(21) Appl. No.: 10/698,705

(22) Filed: Oct. 31, 2003

(65) Prior Publication Data

US 2005/0095918 A1 May 5, 2005

(51) Int. Cl.[7] ..... H01R 24/00

(52) U.S. Cl. ..... 439/660; 439/909; 439/108; 439/608

(58) Field of Search ..... 439/909, 660, 439/108, 608

(56) References Cited

U.S. PATENT DOCUMENTS

| | | | | | |
|---|---|---|---|---|---|
| 4,382,653 | A | * | 5/1983 | Blanchard | 439/610 |
| 5,295,843 | A | * | 3/1994 | Davis et al. | 439/108 |
| 5,741,143 | A | * | 4/1998 | Hotea et al. | 439/86 |
| 6,109,984 | A | * | 8/2000 | Tsou | 439/888 |
| 6,218,669 | B1 | * | 4/2001 | Call | 250/370.11 |
| 6,743,055 | B1 | * | 6/2004 | Flynn et al. | 439/651 |

* cited by examiner

*Primary Examiner*—Truc Nguyen
(74) *Attorney, Agent, or Firm*—Haynes and Boone, LLP

(57) ABSTRACT

An assembly and method for connecting between two electrical components, according to which an electrical current path is established between the two components, and an additional path is established for transmitting any electrical noise generated during operation of the components.

12 Claims, 2 Drawing Sheets

ASSEMBLY AND METHOD FOR CONNECTING ELECTRICAL MEDICAL COMPONENTS

BACKGROUND

This invention relates to medical systems and medical devices, and more specifically to an assembly and method for connecting two electrical devices used in an operating room or other medical environment.

Medical procedures such as surgeries have many requirements that do not exist in other applications. As powered surgical instruments are introduced into medical procedures, these requirements must be considered. For example, many medical procedures utilize electrically operated systems, such as hand held tools, that are connected by a cable assembly to a control console that includes a power supply for the tool. During operation of these systems, very low frequency electrical noise is often generated which can interfere with other electrical equipment, such as nerve monitoring equipment, etc., that also may be used in the procedures.

Attempts to combat this problem include reducing the isolating rating of the system, or using a relatively large and heavy isolation transformer power supply in the control console. However, both of these solutions are less than optimum.

Therefore, what is needed is a system of the above type that does not generate electrical noise that interferes with other equipment, yet does not involve a reduced isolation rating or a relatively large and heavy power supply.

SUMMARY

A system and method for connecting two electrical components used in an operating room is provided. In one embodiment, an assembly connecting between two electrical components such as an electric console and an electrical surgical instrument is provided. The assembly comprising at least one electrical conductor electrically connected between the two components for establishing an electrical current path between the two components, and an electrical conductive shield extending around at least a portion of the conductor for establishing an additional path for transmitting any electrical noise generated during the operation of the components.

In another embodiment, a method for connecting between an electrical surgical instrument(first component) and an electrical power supply (second component) is provided. The method comprises establishing an electrical current path between the instrument and the supply, and establishing an additional path for transmitting any electrical noise generated during the operation of the components.

In yet another embodiments, an operating room assembly for connecting between two electrical components used in a surgical environment is provided. The assembly comprises means for establishing an electrical current path between the two components, and means for establishing an additional path for transmitting any electrical noise generated during the operation of the components.

One advantage of one or more of the present embodiments is that an electrical surgical system is provided that does not generate electrical noise that interferes with other equipment, yet does not involve a reduced isolation rating or a relatively large and heavy power supply.

Additional advantages will be apparent upon review of the attached drawings and the following detailed description. It is understood, however, that several embodiments are disclosed and not all embodiment will benefit from the same advantages.

DETAILED DESCRIPTION

Figure 1B:
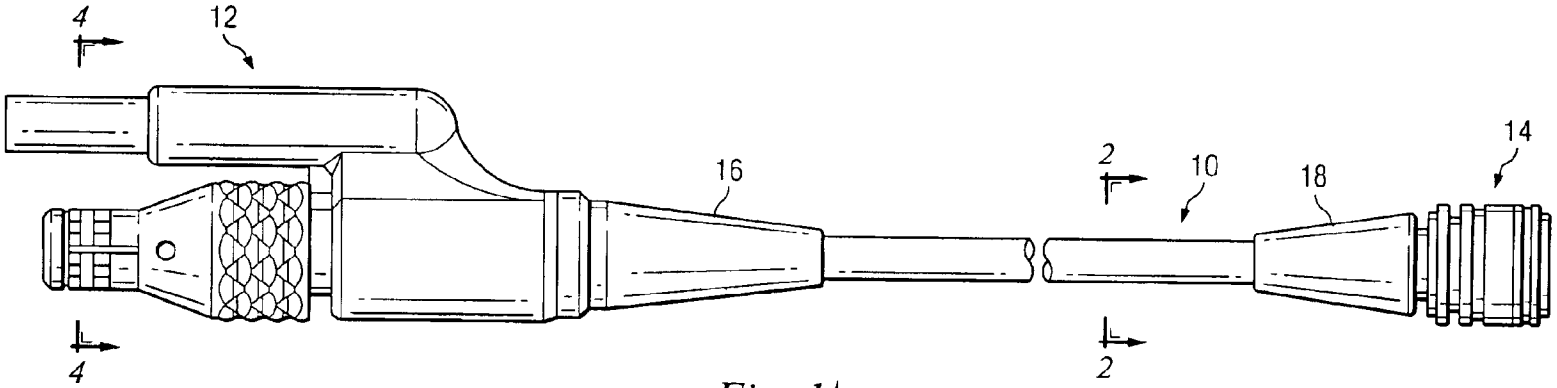
FIG. 1*b* is an elevational view of an embodiment of the invention.
Figure 1A:
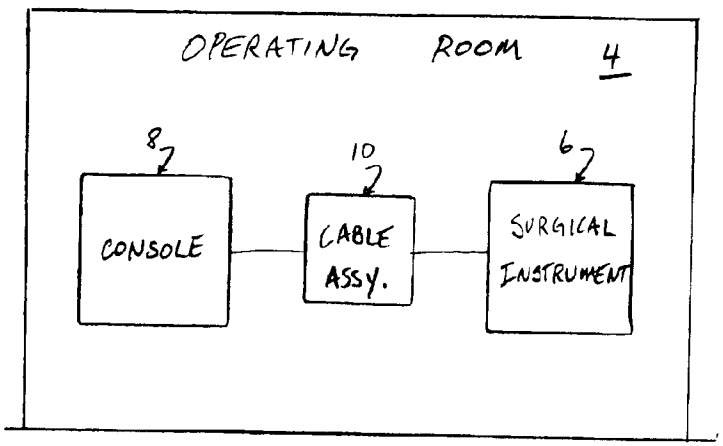
FIG. 1*a* is a block diagram of an operating room in which one or more embodiments of the present invention can be utilized.

Referring to FIG. 1*a* of the drawings, the reference numeral 4 refers, in general, to an operating room in which one or more embodiments of the present invention can be employed. The operating room utilizes a surgical instrument 6 connected to a power supply 8 via a cable assembly 10. For example, the surgical instrument 6 may be a motor connected to a burr for cutting or removing bone or tissue, the power supply 8 may be an electrically control console, and the cable assembly 10 electrically and/or physically connects the power supply to the instrument.

The surgical instrument 6 has utility for various applications in which it is desired, including but not limited to:

1. Arthroscopy—Orthopaedic;
2. Endoscopic—Gastroenterology, Urology, Soft Tissue;
3. Neurosurgery—Cranial, Spine, and Otology;
4. Small Bone—Orthopaedic, Oral-Maxiofacial, Ortho-Spine, and Otology;
5. Cardio Thoracic—Small Bone Sub-Segment;
6. Large Bone—Total Joint and Trauma; and
7. Dental and other applications.

Referring to FIG. 1*b*, two connectors 12 and 14 are connected to the respective ends of the cable assembly 10 for connecting to the console 8 and to the instrument 6, respectively, for transmitting the electrical power from the console to the instrument. Two tapered boots 16 and 18 extend around the termination points between the respective ends of the cable assembly 10 and the connectors 12 and 14, and are connected to, or interlocked with, the connectors for providing stress relief, in a conventional manner.

Figure 2:
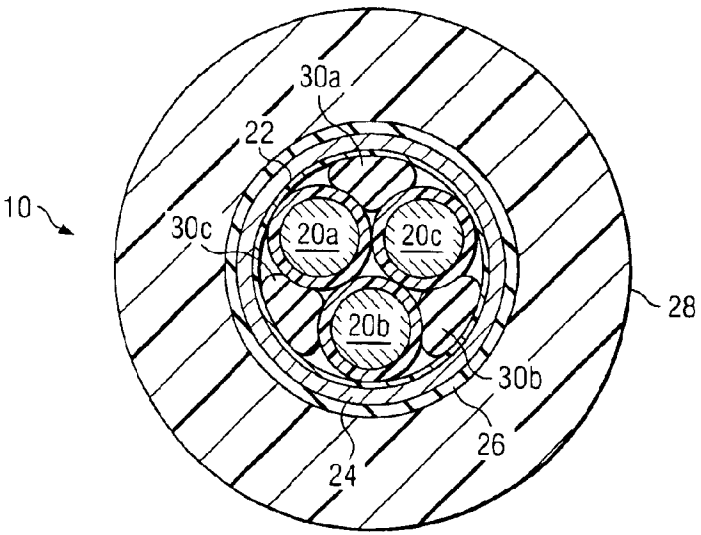
FIG. 2 is an enlarged transverse cross sectional view taken along the line 2—2 of FIG. 1*b*.

As shown in FIG. 2, the cable assembly 10 consists of three inner cables 20*a*, 20*b*, and 20*c*, each consisting of an electrical conductor surrounded by an insulating sheath. An isolating sheath 22, fabricated from a dielectric material, extends around the cables 20*a*, 20*b* and 20*c*, and a braided shield 24, fabricated from an electrical conductive material, extends around the sheath 22. An isolating sheath 26, fabricated from a dielectric material, extends around the shield 24 and an outer insulating jacket 28 extends around the sheath 26. Three angularly-spaced, elongated fillers 30*a*, 30*b*, and 30*c*, each fabricated from a dielectric material, extend between the cables 20*a*, 20*b* and 20*c*, and the inner surface of the sheath 22.

The connector 14 (FIG. 1*b*) is conventional, and as such, is adapted to connect to the hand held instrument 6 in a conventional manner and to receive the corresponding end of the cable assembly 10 in a manner so that the corresponding ends of the conductors of the cables 20*a*, 20*b*, and 20*c* (FIG. 2) are connected to proper terminals, or the like, on the instrument 6 to permit the electrical power from the console to be transmitted to the instrument 6 to drive it. To permit these connections, the end portions of the shield 24, the sheath 26 and the jacket 28 are stripped off the corresponding end portions of the conductors 20*a*, 20*b* and 20*c*. It is noted that the new end portion of the shield 24 that is formed as a result of this stripping is not connected to the connector 14 or to the instrument 6.

Figure 4:
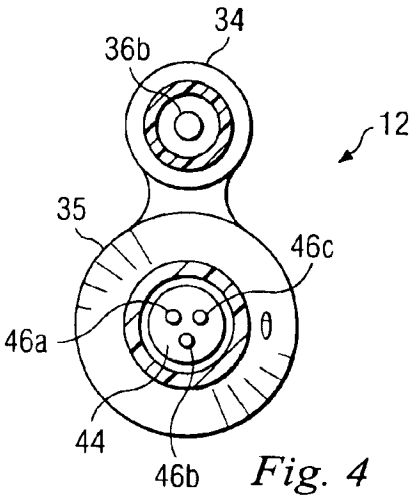
FIG. 4 is an enlarged transverse cross sectional view taken along the lines 4—4 of FIG. 1*b*.
Figure 3:
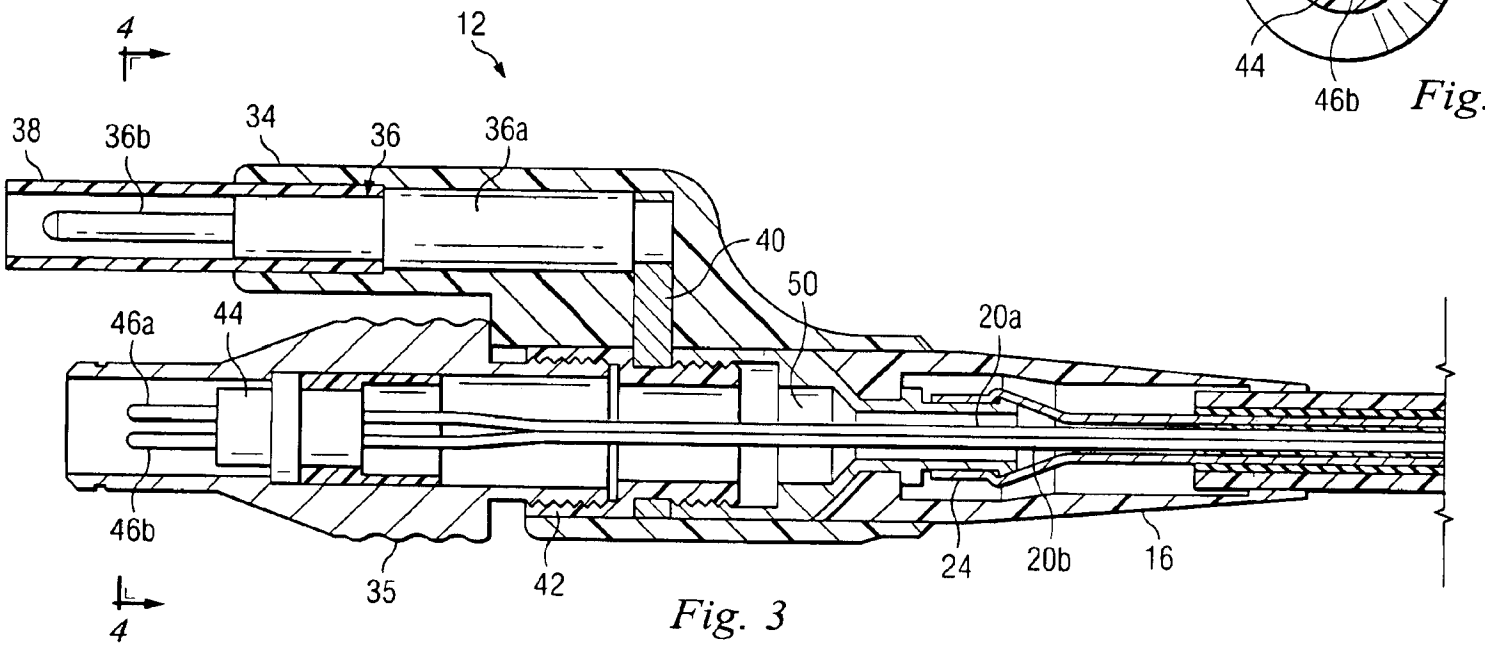
FIG. 3 is an enlarged longitudinal cross sectional view of a component of the embodiment of FIG. 1*b*.

As shown in FIGS. 3 and 4, the connector 12 consists of two housings 34 and 35 each having a substantially circular cross section and each defining a bore. The housing 34 is fabricated from a molded insulative material and the housing 35 is fabricated from a metallic material.

A connector, or terminal, 36 is provided in the housing 34 and has a body portion 36*a* having a stepped outer diameter, and a pin portion 36*b* extending from one end of the body portion. The body portion 36*a* extends in a bore formed in the housing 34 and the pin portion 36*b* projects from the bore. A portion of a barrel 38 extends between an outer surface portion of the body portion 36*a*, and the corresponding inner surface of the housing 34 defining the above bore. A portion of the barrel 38 projects from the housing 34 and surrounds the pin portion 36*b* of the terminal 36 in a spaced relationship. It is understood that a complementary socket is provided on the control console that receives the pin portion 36*b* of the terminal 36 and the barrel 38, and that the latter socket is connected to ground in a conventional manner, for reasons to be described.

A bridge member 40 is embedded in the material of the housing 34 and is fabricated from an electrical conductive material, such as metal. An outer surface portion of the bridge member 40 is in intimate contact with the other end of the body portion 36*a* of the terminal 36.

Another portion of the bridge member 40 projects out from the housing 34 and contacts the outer surface of an adapter bushing 42 that is fabricated from a dielectric material. One end portion of the housing 35 is in threaded engagement with one end portion of bushing 42, and the housing 35 defines a bore that receives a terminal block 44 fabricated from a dielectric material. Three spaced pin connectors 46*a*–46*c* extend through the terminal block 44 with the respective ends of each pin projecting from the terminal block. The other end portion of the housing 35 surrounds the corresponding projecting end portions of the pin connectors 46*a*–46*c* to form a connecter that is connected to a complementary socket in the control console.

One end portion of a tubular housing 50 is in threaded engagement with the other end portion of the bushing 42 and the other end portion of the housing is surrounded by the boot 16. The housing 50 is fabricated from an electrical conductive material, such as metal.

The cable assembly 10 extends through the boot 16 and the housing 50 and the sheaths 22 and 26, the shield 24, and the jacket 28 are stripped from that portion of the cable assembly 10 extending through the housing 50 and a portion of the boot 16. The stripping is such that the exposed end portions of the cables 20*a*–20*c* are longer than the exposed end portion of the shield 24. The exposed end portions of the cables 20*a*–20*c* extend though the bores in the boot 16, the housing 50 and the housing 35, and the exposed end portion of the shield 24 extends over the corresponding outer surface of the housing 50. The respective ends of the cables 20*a*–20*c* are connected to one end of the pins 46*a*–46*c*, respectively, and the exposed end portion of the shield 24 is connected to the housing 50, such as by soldering, or the like.

The end of the housing 50 that is in threaded engagement with the bushing 42 also is in intimate contact with the bridge member 40 so that an electrical conductive path is established through the shield 24, the housing 50, the bridge member 40, and the terminal 36 for any electrical noise generated during the operation of the hand instrument 6 and the console. This electrical conductive path is electrically isolated from the housing 35 by the bushing 42, and from the current path established by the cables 20*a*–20*c*. As a result, any electrical noise generated during the operation of the hand held instrument 6 and the console is directly discharged to ground through the pin 38 and the above-mentioned socket on the control console.

In operation, the connector 14 is mechanically and electrically connected to the hand held instrument 6 in any conventional manner, and the housings 34 and 35 of the connector 12 are connected to appropriate sockets, on the control console in the manner described above. The socket on the control console that receives the housing 35 is connected to a power supply in the control console for providing electrical power that is transmitted, via the connector 12, the cables 20*a*–20*c*, and the connector 14, in a standard "floating ground" configuration, to the hand held instrument 6 for driving it, in a conventional manner.

The other socket on the control console that receives the terminal pin 36*b* dissipates the electrical noise generated during the operation of the instrument 6 and the console directly to ground. This eliminates any interference with relatively sensitive ancillary equipment being used in the vicinity of the hand held instrument 6. For example, if the instrument 6 is used in a medical procedure, relatively sensitive equipment, such as a nerve monitoring device, for example, may be used in the same procedure as the instrument 6 without the danger of interference from electrical noise from the instrument 6 and the console. Also, this is achieved with the shield 24 not being connected to the instrument 6 as discussed above, so that the instrument 6 retains a "body floating" rating as opposed to a reduced isolation rating. Moreover, the distance between the instrument 6 and the terminal 36 is far in excess of the minimum to achieve a "body floating" rating per the applicable assembly UL standards. Further, the body floating rating can be achieved while using a relatively small and light power supply, such as a switching power supply, at the control console.

Variations and Alternatives

It is understood that variations may be made in the foregoing without departing from the scope of the invention. For example, the cable assembly 10 can be connected between two other electrical components in a manner identical to that disclosed above and the electrical components do not have to be limited to those used in medical procedures. Also, the cable assembly 10 can include additional conductors for transmitting signals between the control console to the instrument 6. Moreover, the present invention is not limited to the particular shape and configuration of the connector 12.

Those skilled in the art will readily appreciate that many other modifications are possible in the exemplary embodiments discussed above without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. An operating room assembly for connecting between two electrical components used in a surgical environment, the assembly comprising at least one electrical conductor electrically connected between the two components for establishing an electrical current path between the two components, and an electrical conductive shield extending around at least a portion of the conductor for establishing an additional path for transmitting any electrical noise generated during the operation of the components, wherein one end of the shield is electrically grounded at one of the components, and wherein the other end of the shield is not electrically connected to either component.

2. The assembly of claim 1 wherein the additional path is electrically isolated from the electric current path.

3. The assembly of claim 1 wherein the additional path is connected to ground at one of the components to dissipate the electrical noise.

4. The assembly of claim 1 further comprising one connector connected to one end of the conductor and adapted to engage one component to electrically connect the conductor to the one component, and another connector connected to the other end of the conductor and adapted to engage the other component to electrically connect the conductor to the other component.

5. The assembly of claim 1 further comprising a connector connected to the conductor and adapted to engage the one component to electrically connect the conductor to the one component.

6. The assembly of claim 5 wherein the connecter is also connected to the shield for electrically connecting the shield to ground at the one component.

7. The assembly of claim 6 wherein the connector establishes separate electrical conductive paths for the current flowing through the conductor and any electrical noise flowing through the shield.

8. The assembly of claim 5 wherein the connector is connected to one end of the conductor and further comprising another connector connected to the other end of the conductor and adapted to engage the other component to electrically connect the conductor to the other component.

9. The assembly of claim 4 wherein one end of the shield is connected to the one connector, and wherein the other end of the shield extends proximately to the other connector and is not electrically connected to the other connector.

10. The assembly of claim 9 wherein separate electrical conductive paths are established in the one connector for the current flowing through the conductor and for any electrical noise flowing through the shield.

11. The assembly of claim 9 wherein the shield is connected to ground at the one component to dissipate the electrical noise.

12. The assembly of claim 4 wherein one end of the shield is connected to the one connector, and wherein the other end of the shield is mechanically connected to the other connector and is not electrically connected to the other connector.

* * * * *